United States Patent [19]

Jodrey

[11] 4,405,403

[45] Sep. 20, 1983

[54] ARTICLE HOLDING TURRET

[75] Inventor: Robert M. Jodrey, Westboro, Mass.

[73] Assignee: Dennison Manufacturing Company, Framingham, Mass.

[21] Appl. No.: 255,968

[22] Filed: Apr. 20, 1981

[51] Int. Cl.[3] ..... B44C 1/00; B65C 9/04; B65C 9/00

[52] U.S. Cl. ..... 156/449; 156/542; 156/475; 156/567; 156/DIG. 26; 192/12 R

[58] Field of Search ..... 156/352, 362, 361, 449, 156/456, 541, 542, 540, 567, 556, DIG. 27, DIG. 26, DIG. 25, DIG. 44, 451, 464, 475, DIG. 11; 74/121, 117, 124, 125.5, 133, 577 M, 116.5; 192/12 R, 12 A

[56] References Cited

U.S. PATENT DOCUMENTS

| | | | |
|---|---|---|---|
| 500,566 | 7/1893 | Dunn | 156/456 |
| 2,612,785 | 10/1952 | Wiltsey | 74/124 |
| 3,208,897 | 9/1965 | Flood | 156/542 |
| 3,267,754 | 8/1966 | Bouchez | 74/117 |

*Primary Examiner*—Edward C. Kimlin
*Assistant Examiner*—Louis Falasco
*Attorney, Agent, or Firm*—Arthur B. Moore; George E. Kersey; Barry D. Josephs

[57] ABSTRACT

An article-holding turret which is particularly suitable for rotatably conveying large objects. A friction brake is fixed to a pawl plate, and these axially mounted structures are oscillated by a rack and pinion assembly driven from a turret index shuttle. A ratchet and spindle assembly is coaxially mounted on the turret's central shaft, and caused to periodically index through desired angular intervals by a pawl carried on the pawl plate. The forward rotation of the ratchet and spindle assembly is accompanied by a commensurate rotation of the friction brake, thereby minimizing rotational drive forces required during this segment. An auxiliary pawl and bracket assembly prevents retrogression of the ratchet and spindle during the reverse oscillation of the friction brake assembly.

12 Claims, 10 Drawing Figures

ARTICLE HOLDING TURRET

BACKGROUND OF THE INVENTION

The present invention relates to apparatus for holding and conveying articles, and more particularly to turrets for rotatably conveying large containers.

One well known type of apparatus for holding containers and other articles during processing is the so-called turret. The turret engages one or more articles and rotatably conveys these articles during decoration, filling, and other processing steps.

One typical class of apparatus incorporating such turrets is the decorating apparatus shown generally in FIG. 1. The decorator 100 transfers labels from a carrier web 150 to articles held in a rotating turret 10. The label transport includes unwind roll 110, metering roll 120, a shuttle 130 with shuttle rolls 133 and 137, rewind roll 140, and various dancer and idler rolls. Labels are pressed from carrier web 150 onto articles by a transfer roll 33. Drive mechanisms not shown regulate the web transport; this is coordinated with the indexing of the turret 10 by means of a turret shuttle arm 68.

Turrets are commonly characterized by intermittent motion, whereby the turret is indexed through a given angle to deliver each succeeding article to or through a processing station. In the case of turrets for holding articles of substantial size, this stop and go motion has engendered a number of mechanical problems. Prior art intermittent motion turret designs have typically incorporated a stationary brake to prevent the rotating elements of the turret from overtravelling; a considerable braking force is required in the case of turrets for conveying large articles.

FIG. 2 shows in section prior art mounting apparatus for a rotating turret such as the turret 10 of FIG. 1. The turret includes a central shaft 11 encased in a spindle 15. Attached to the spindle 15 are various rotor devices including an article cup 30 and article-engaging spiders 13, which periodically rotate counterclockwise along with the spindle through a given angle (such as 90° for a four-station turret). Spindle 15 is fitted to a ratchet 45, while shaft 11 is fitted to a pawl plate 36. Pawl plate 36 is oscillated through a given angle by means of a rack and pinion assembly consisting of pinion gear 61, rack 62, and tube 63 driven by a shuttle arm 68 (FIG. 1).

During the forward, counterclockwise segment of this oscillation, the pawl plate 36 drives the ratchet 45 by engaging it with pawl 35. During the remainder of each cycle, a stationary brake 40 prevents overtravelling of ratchet 45. The driving mechanisms of turret 10 must overcome brake 40 during the forward cycle, which requires a considerable accelerating force for a turret of substantial size. This results in significant machine stresses and a tendency toward vibration during the forward cycle. In the decorator of FIG. 1, such machine vibration causes a periodic distortion of the imprinted image.

Accordingly, it is a primary object of the invention to provide an improved turret design which is especially suitable for conveyance of articles in a turret of relatively large diameter. A related object is the minimization of mechanical problems associated with such turrets. A further related object is the provision of a machine design which minimizes rotational drive forces required during the forward cycle of turret oscillation.

Another object of the invention is the achievement of a turret to hold large articles during decoration. A related object is the enhancement of image quality for inscribed indicia. A further related object is the avoidance of periodic image distortion associated with turret vibration.

SUMMARY OF THE INVENTION

In furthering the above and related objects, the invention provides novel mounting apparatus and drive mechanisms for a rotating turret. The mounting and drive mechanisms include a pawl plate fitted to a central shaft of the turret, and a rack and pinion assembly which induces the periodic rotational oscillation of the pawl plate and central turret shaft. A ratchet and spindle assembly is coaxially mounted on the central turret shaft, allowing relative rotation of these structures. A friction brake which limits the rotation of the spindle is coupled to the pawl plate.

In accordance with one aspect of the invention, the friction brake rotationally oscillates in conjunction with the pawl plate. During the first half of each machine cycle the friction brake rotates commensurately with the ratchet and spindle assembly and remainder of the rotor assembly thereby minimizing undesirable rotational drive forces required during this period. During the second half of each machine cycle, the ratchet and spindle are held stationary while the friction brake undergoes reverse rotation.

In accordance with another aspect of the invention, the indexing of the ratchet and spindle assembly is controlled by a pair of pawls. The ratchet is rotationally driven during a first half cycle by engagement with a first pawl appended to the pawl plate. The ratchet and spindle are held stationary during a second half cycle by means of an auxiliary pawl mounted to a stationary bracket. In the preferred embodiment, the ratchet and spindle assembly are indexed through an angle inversely proportional to the number of article stations.

In accordance with a further aspect of the invention, the turret assembly is adapted for the processing of articles during each first half cycle, during which the article is rotated through the processing station. In a particular embodiment, the turret is incorporated in a heat transfer labelling device in which a label-bearing web is pressed against the container's surface for labelling. An advantageous feature of the present invention is that it allows the use of large turrets in decorators of this type, while significantly reducing mechanical problems and degradation of image quality.

BRIEF DESCRIPTION OF THE DRAWINGS

The above and related aspects of the invention are further illustrated with reference to the detailed description which follows, taken in conjunction with the drawings in which.

DETAILED DESCRIPTION

Figure 1:
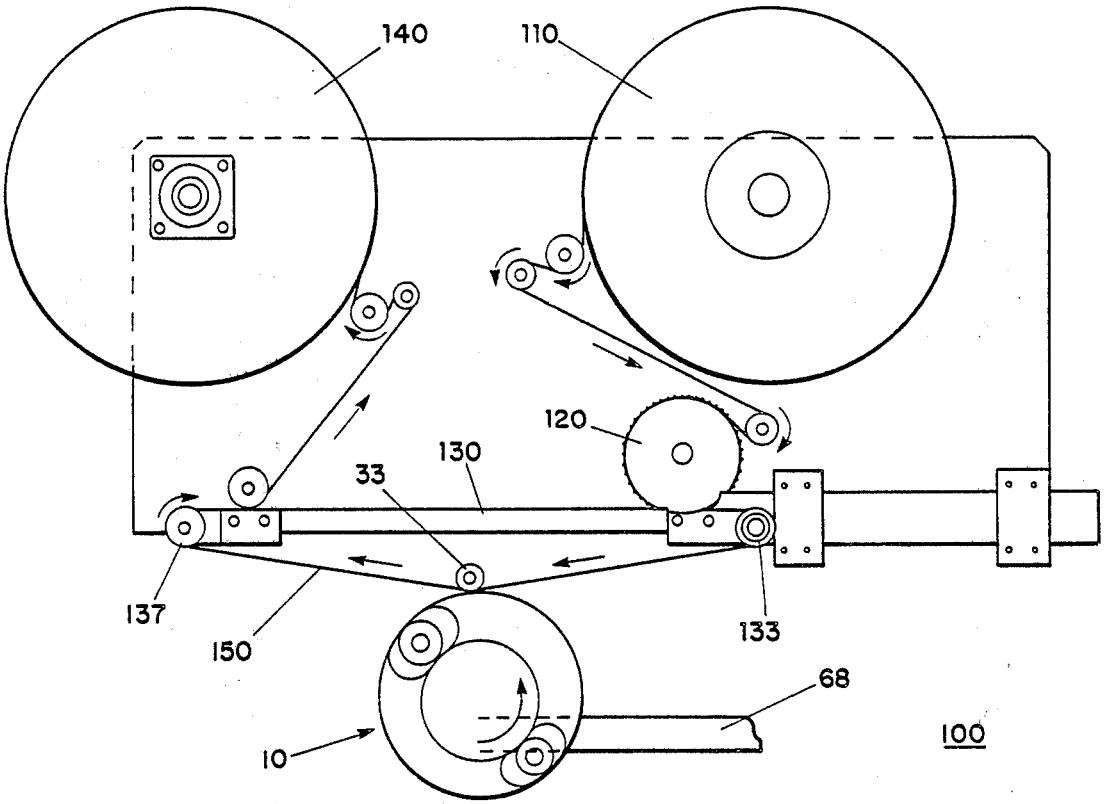
FIG. 1 PRIOR ART
FIG. 1 is a plan view of a heat transfer labelling device as known in the prior art, including an article-holding turret.
Figure 3:
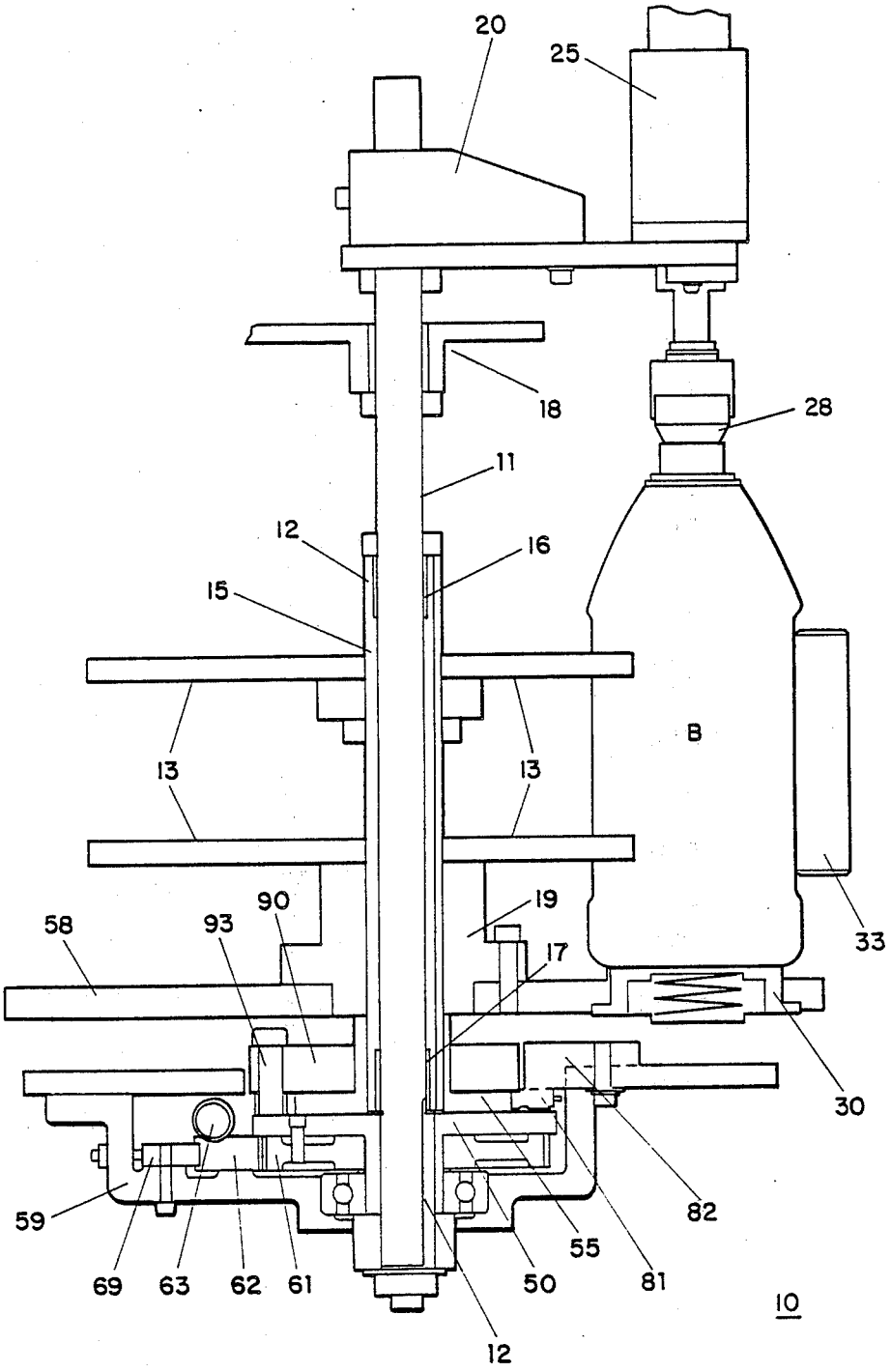
FIG. 3 is a sectional elevation view of a turret in accordance with a preferred embodiment of the invention.

The article-holding turret of the invention is illustrated at 10 in the partial sectional view of FIG. 3. The turret 10 includes a rotor assembly comprising a ratchet 55, spindle 15, rotor hub 19, rotor plate 58, container cup 30, and spiders 13. This rotor assembly rotates as a unit, carrying articles in one or more turret stations or container cups 30. The turret 10 periodically indexes this rotor assembly in counterclockwise rotation, as explained below. Illustratively, the turret assembly rotationally conveys a plurality of articles B past a transfer roller 33, which presses a label-carrying web 150 against the articles—see FIG. 1.

The turret 10 further includes a central assembly consisting of shaft 11, pawl plate 50, cylinder bracket 20, and air cylinder 25. This assembly periodically oscillates through an angle corresponding to the indexing angle of the rotor assembly, as explained below. Illustratively, the air cylinder 25 lowers an inflation nozzle 28 into each article B, providing low pressure air to inflate the article during decoration.

The turret 10 is advantageously steadied by an upper support bracket 18, shown in part. During each machine cycle, the central mechanism of the turret rotationally oscillates through a given angle, illustratively 90° for the four-station turret of FIG. 4. More generally, the angle of rotation advantageously is defined as (360°/number of turret stations.) Each machine cycle includes a first, forward segment during which pawl plate 50 rotates in a counterclockwise sense, and a second, reverse segment of clockwise rotation.

Figure 4:
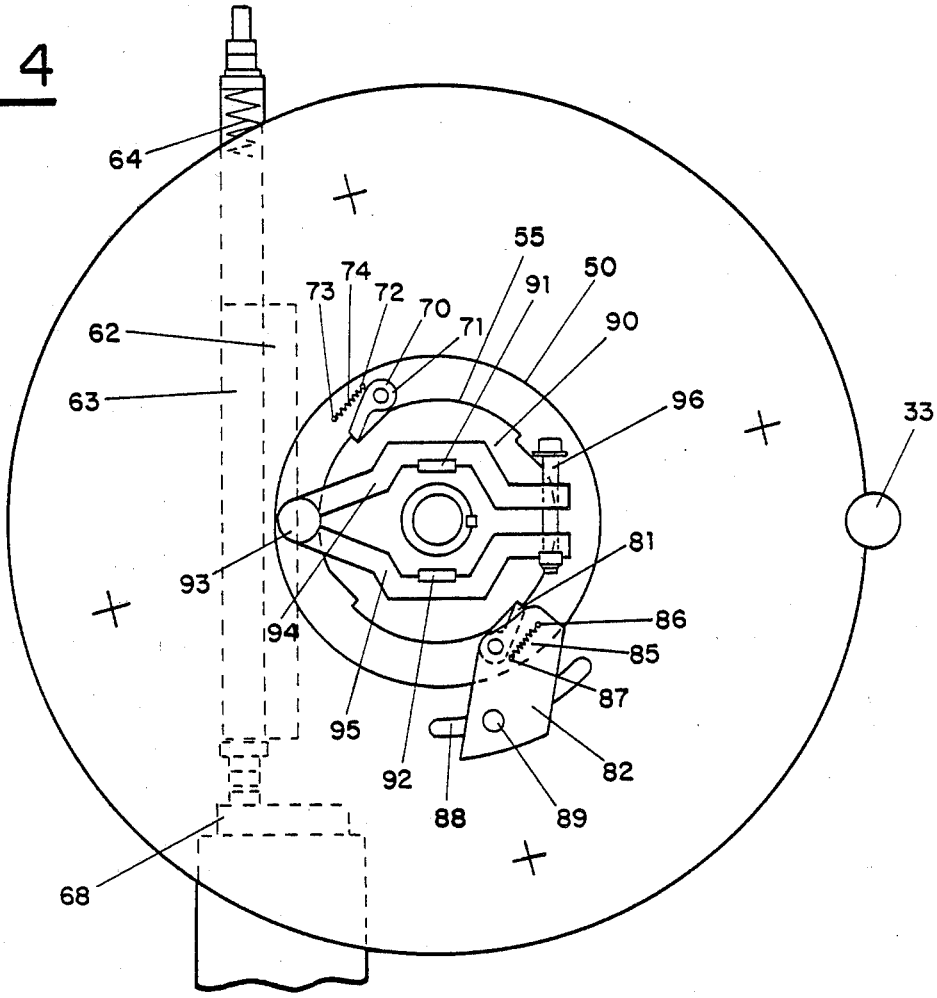
FIG. 4 is a plan view of the turret area of a labelling device of the type shown in FIG. 1, incorporating the turret of FIG. 3.
Figure 7:
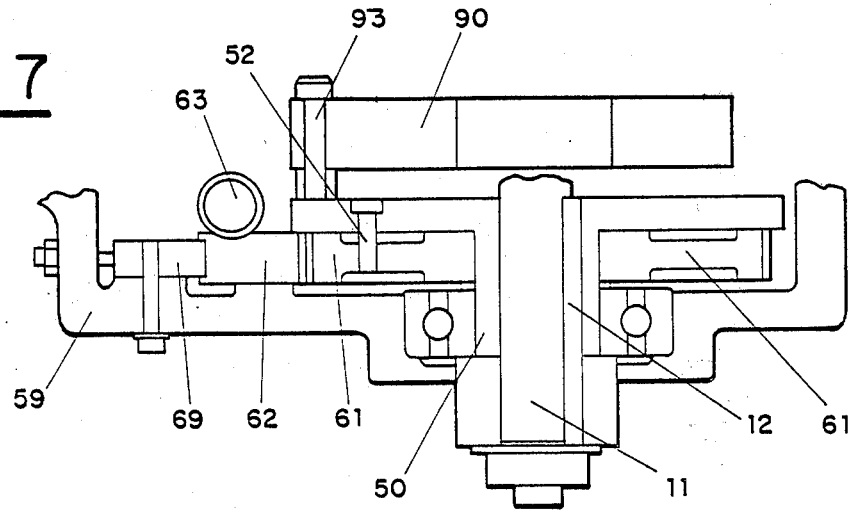
FIG. 7 is a sectional view of the pawl plate, brake, and rack and pinion assembly of FIG. 3.
Figure 8:
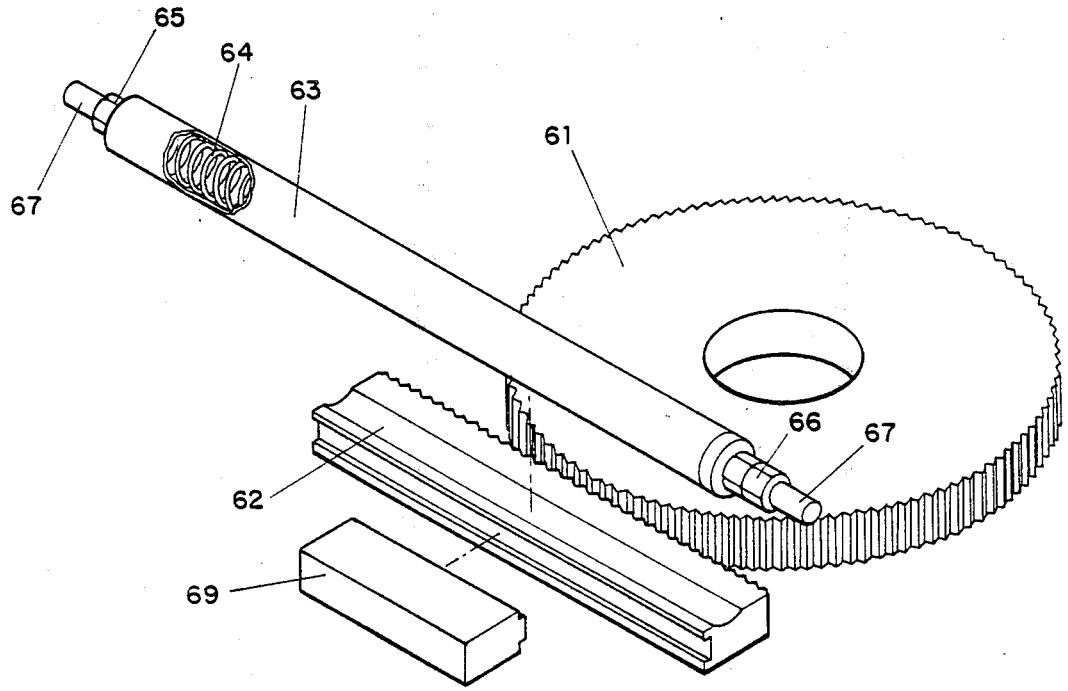
FIG. 8 is an exploded perspective view of the rack and pinion assembly of FIG. 7.

The driving mechanisms for turret rotation are illustrated in FIGS. 7 and 8. As shown in the partial sectional view of FIG. 7, the pawl plate 50 is coupled to the central turret shaft 11, with a key 12 inserted to prevent relative rotation. The pawl plate 50 is fastened at 52 to a pinion gear 61, which in turn meshes with a rack 62. The rack 62 slidingly engages a rack bearing 69, which is mounted to a support structure 59. The rack 62 is coupled to a tube 63, which is reciprocated by rod 67 and turret shuttle 68 (FIG. 4). As shown in FIG. 8, the tube 63 preferably includes an internal compression spring 64, and is capped at each end by washer and nut assembly 65 and 66; these devices provide a pressure release mechanism in the event of machine jams.

As one of the novel features of the present apparatus, friction brake assembly 90 is coupled at 93 to pawl plate 50. This friction brake therefore undergoes an identical rotational oscillation as the previously discussed central turret assembly.

Figure 6:
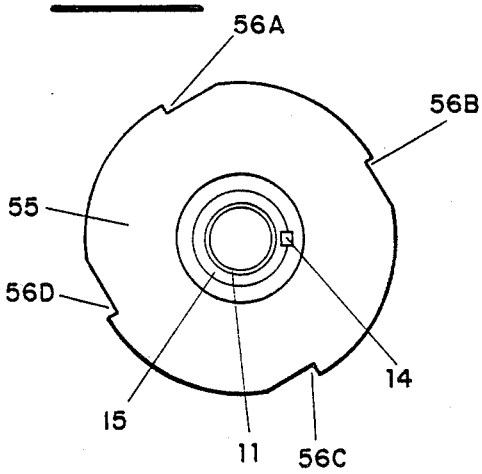
FIG. 6 is a plan view of the ratchet and spindle assembly of FIG. 5, as seen from above.

As shown in the plan view of FIG. 4, during the first half of each machine cycle, the pawl plate 50 drives the ratchet 55 by means of pawl 70. The ratchet 55 includes a plurality of peripheral notches **56*a*, 56*b*, etc., as shown in FIG. 6, advantageously equal in number to the number of turret stations. The pawl 70, rotationally mounted on pawl plate 50 by stud 71, is further coupled to the pawl plate by pins 72 and 73 and expansion spring 74. Expansion spring 74 exerts a counterclockwise torque tending to force the pawl into engagement with a given notch 56 of ratchet 55. The ratchet 55 therefore rotates in conjunction with pawl plate 50** during each forward half-cycle.

Figure 2:
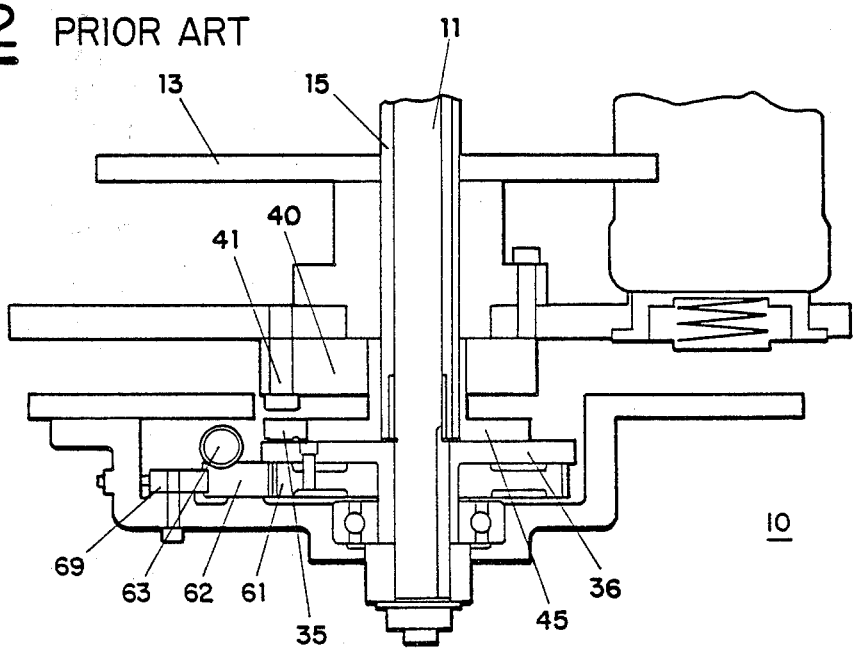
FIG. 2 PRIOR ART
FIG. 2 is a partial sectional elevation view of a turret in accordance with the prior art.
Figure 5:
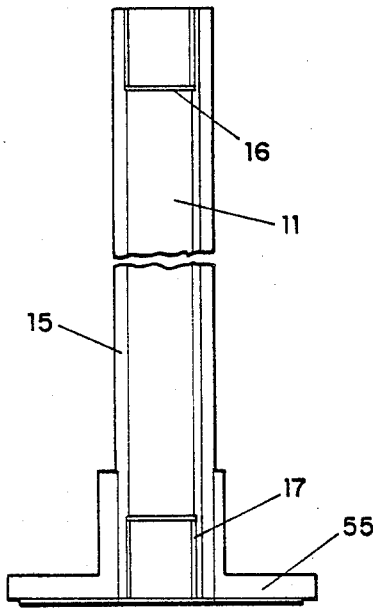
FIG. 5 is an elevation view of the ratchet and spindle assembly of FIG. 3.

Ratchet 55 is secured to spindle 15 by welding, brazing or other suitable means, to prevent relative rotation (FIG. 5). Spindle 15 comprises an outer sleeve for central turret shaft 11, and is freely rotatable around bearings 16 and 17. During each forward half cycle, the friction brake assembly 90 rotates along with the remainder of these mechanisms, thereby avoiding any undesirable frictional torques during this period. This alleviates the problems of machine vibration and undesirable stresses characteristic of the prior art turret assembly of FIG. 2. This is a particularly advantageous feature in the decorating apparatus of FIG. 1, in which article decoration occurs during this period.

Figure 10:
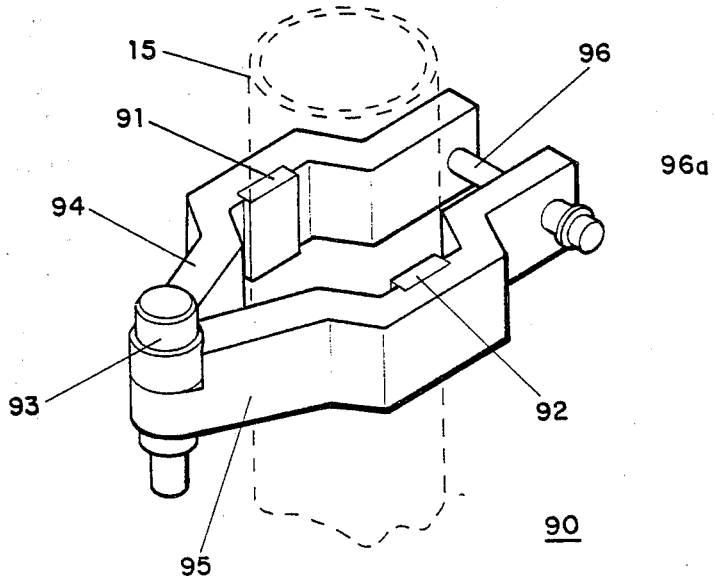
FIG. 10 is a perspective view of the friction brake assembly of FIG. 3.

During the second segment of each machine cycle, as previously discussed, the pawl plate 50 and associated central turret mechanisms undergo reverse, clockwise rotation. It is necessary during this period to prevent the retrogression of the turret rotor assembly, which should be held stationary pending beginning of the next machine cycle. There is a natural tendency toward reverse rotation for the ratchet and spindle assembly by virtue of the frictional torque exerted by friction brake assembly 90. As shown in the perspective view of FIG. 10, an illustrative friction brake assembly 90 includes brake arms 94 and 95, which respectively bear brake pads 91 and 92. The brake is adjusted to a desired tension using adjusting screw 96 and compression spring **96*a*, thereby clamping brake pads 91 and 92 around spindle 15. It is necessary to overcome this frictional resistance in order to achieve a relative rotation of the spindle 15 and brake assembly 90**.

Figure 9:
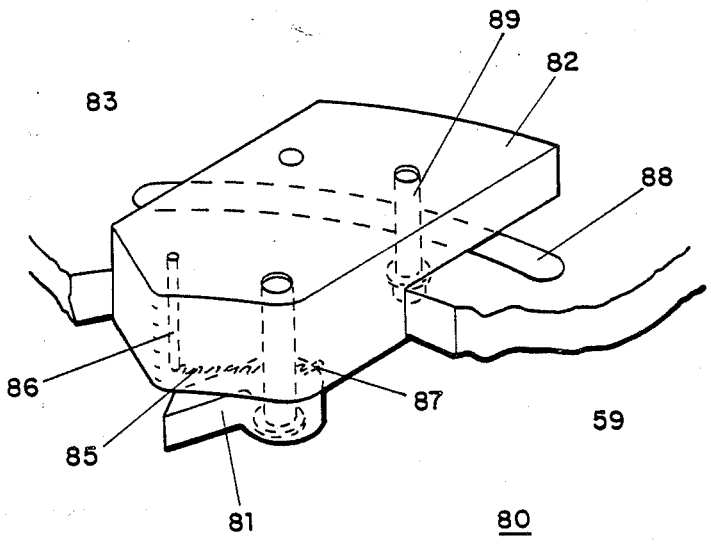
FIG. 9 is a perspective view of the auxiliary pawl and bracket assembly of FIG. 3.

With reference to FIGS. 4 and 9, the retrogression of the rotor assembly is prevented by an auxiliary pawl and bracket assembly 80. The assembly 80 includes a bracket 82 which is mounted to support structure 59. The angular location of the bracket and pawl assembly 80 may be adjusted by repositioning screw 89 within arcuate slot 88. This assembly should be placed so that at the end of a given first half cycle pawl 81 pops into one of the notches 56 of ratchet 55. As shown in FIG. 9, pawl 81 is pinned to bracket 82, and is subjected to a counterclockwise torque by expansion spring 85. Therefore, during each reverse half-cycle, the pawl 81 prevents the reverse rotation of ratchet 55 and the associated rotor mechanisms. There may be certain machine stresses and vibrations during this period, but these will interfere with no article processing functions.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims. Although the illustrated embodiment shows the turret of the invention in article decorating apparatus, such a turret may be incorporated in a wide variety of article processing apparatus.

I claim:

1. An improved article-holding turret of the type including a rotor assembly for engaging and rotatably conveying articles, past a labeling site whereby labels are applied to the articles an oscillating drive assembly for indexing the rotor assembly through a predetermined angle in a forward direction, and a brake for preventing the rotation of the rotor assembly in the reverse direction, wherein in the improved turret the brake rotates with the drive assembly, said turret further comprising means for preventing the reverse rotation of the rotor assembly during the reverse rotation of the drive assembly and brake.

2. Apparatus as defined in claim 1 of the type in which the turret further includes a central shaft which oscillates with the drive assembly, and in which the rotor assembly includes a ratchet and spindle rotatably and coaxially mounted to said central shaft, wherein the improved drive assembly comprises:

a pawl plate fixed to said central shaft;

means for inducing a rotational oscillation of said pawl plate; and a first pawl mounted to said pawl plate for engaging said ratchet during the forward rotation of said pawl plate.

3. The improved turret of claim 2 wherein the brake comprises a friction brake fixed to said pawl plate and frictionally engaging said spindle.

4. The improved turret of claim 2 wherein the means for preventing reverse rotation of the rotor assembly comprises a second, stationary pawl for engaging said ratchet during the reverse rotation of the pawl plate and brake, thereby holding said ratchet stationary during said reverse rotation.

5. The improved turret of claim 4 wherein said second pawl is mounted to a stationary bracket.

6. The improved turret of claim 5 further comprising means for adjusting the angular location of said stationary bracket with respect to the axis of said turret.

7. The improved turret of claim 1 wherein said predetermined angle equals (360°/number of articles engaged by rotor assembly.)

8. Improved apparatus for decorating articles comprising, in combination, a periodically rotating article-holding turret for successively conveying articles through a labelling site, a carrier web bearing labels to be transferred to articles, means for transporting the carrier web through the labelling site, and means for pressing labels onto articles from the carrier web, wherein the improvement comprises an improved turret comprising:

a rotor assembly for engaging and rotatably conveying the articles;

a rotatably oscillating drive assembly for indexing the rotor assembly through a predetermined angle in a forward direction;

a brake which rotates with said drive assembly and which resists the relative rotation of the rotor assembly; and means for preventing reverse rotation of the rotor assembly during reverse rotation of the drive assembly and brake.

9. The improved decorator of claim 8 of the type in which the turret includes an oscillating central shaft, wherein the drive assembly comprises:

a pawl plate coaxially jointed to said central shaft;

a rack and pinion drive assembly for inducing the oscillatory rotation of said pawl plate;

means for linking said pawl plate to said rotor assembly during the forward rotation of said pawl plate.

10. The improved decorator of claim 9 said rotor assembly comprises a ratchet; and a spindle joined to said ratchet, said ratchet and spindle being coaxially and rotatably mounted to said central shaft;

and wherein said linking means comprises a first pawl mounted to said pawl plate; and means for forcing said first pawl into engagement with said ratchet during the forward rotation of said pawl plate.

11. The improved decorator of claim 10 wherein said means for preventing reverse rotation of the rotor assembly comprises:

a second, stationary pawl; and means for forcing said second, stationary pawl into engagement with said ratchet during reverse rotation of the drive assembly.

12. The improved decorator of claim 9 wherein said brake comprises a friction brake fixed to said pawl plate.

* * * * *